US010638809B2

(12) United States Patent
Ogawa et al.

(10) Patent No.: US 10,638,809 B2
(45) Date of Patent: May 5, 2020

(54) SHOCK ABSORBER AND SHOE SOLE

(71) Applicant: ASICS CORPORATION, Kobe-shi (JP)

(72) Inventors: Tsuyoshi Ogawa, Kobe (JP); Takashi Inomata, Kobe (JP); Kenta Moriyasu, Kobe (JP)

(73) Assignee: ASICS Corporation (JP)

( * ) Notice: Subject to any disclaimer, the term of this patent is extended or adjusted under 35 U.S.C. 154(b) by 193 days.

(21) Appl. No.: 15/771,061

(22) PCT Filed: Oct. 28, 2016

(86) PCT No.: PCT/JP2016/082109
§ 371 (c)(1),
(2) Date: Apr. 25, 2018

(87) PCT Pub. No.: WO2017/073747
PCT Pub. Date: May 4, 2017

(65) Prior Publication Data

US 2018/0310664 A1 Nov. 1, 2018

Related U.S. Application Data

(63) Continuation-in-part of application No. PCT/JP2015/080787, filed on Oct. 30, 2015.

(51) Int. Cl.

| | |
|---|---|
| ***A43B 7/32*** | (2006.01) |
| ***A43B 17/00*** | (2006.01) |
| ***A43B 13/12*** | (2006.01) |
| ***A43B 13/18*** | (2006.01) |
| ***A43B 17/14*** | (2006.01) |
| ***A43B 5/06*** | (2006.01) |
| ***A43B 13/04*** | (2006.01) |

(52) U.S. Cl.
CPC ..... *A43B 7/32* (2013.01); *A43B 5/06* (2013.01); *A43B 13/04* (2013.01); *A43B 13/12* (2013.01); *A43B 13/18* (2013.01); *A43B 13/188* (2013.01); *A43B 17/003* (2013.01); *A43B 17/006* (2013.01); *A43B 17/14* (2013.01)

(58) Field of Classification Search
CPC .. A43B 5/06; A43B 7/32; A43B 13/04; A43B 13/12; A43B 13/18; A43B 13/188; A43B 17/003; A43B 17/006; A43B 17/14
See application file for complete search history.

(56) References Cited

U.S. PATENT DOCUMENTS

| | | | | |
|---|---|---|---|---|
| 2008/0229622 | A1 | 9/2008 | Mori et al. | |
| 2010/0281712 | A1 | 11/2010 | Campbell et al. | |
| 2011/0265351 | A1 | 11/2011 | Mori et al. | |
| 2013/0000151 | A1 | 1/2013 | Campbell et al. | |
| 2013/0291399 | A1* | 11/2013 | Fonte ..... | A43B 17/006 36/44 |
| 2014/0331519 | A1 | 11/2014 | Campbell et al. | |

FOREIGN PATENT DOCUMENTS

| | | | |
|---|---|---|---|
| JP | H08-280403 | A | 10/1996 |
| JP | 2007-195944 | A | 8/2007 |
| JP | 2010-259811 | A | 11/2010 |
| WO | 2006/121069 | A | 11/2006 |

OTHER PUBLICATIONS

International Search Report for International Application No. PCT/JP20161082109 dated Dec. 6, 2016.

* cited by examiner

*Primary Examiner* — Edward J Cain
(74) *Attorney, Agent, or Firm* — Katten Muchin Rosenman LLP

(57) ABSTRACT

Provided is a shock absorber formed by a resin composition and provided in a shoe, the shock absorber satisfying all formulas (1) to (4) below when changes in storage elastic modulus between 20° C. to 50° C. are linearly approximated by a least-squares method: $Y=aX+b$ . . . (1); $-0.1 \leq a \leq -0.02$ . . . (2); $1.0 \leq b \leq 16.0$ . . . (3); and $R^2 \geq 0.75$ . . . (4), where X represents a temperature (unit: ° C.) of the shock absorber, Y represents a storage elastic modulus of the shock absorber, and R represents a correlation coefficient in the least-squares method.

12 Claims, 10 Drawing Sheets

【Fig. 1】
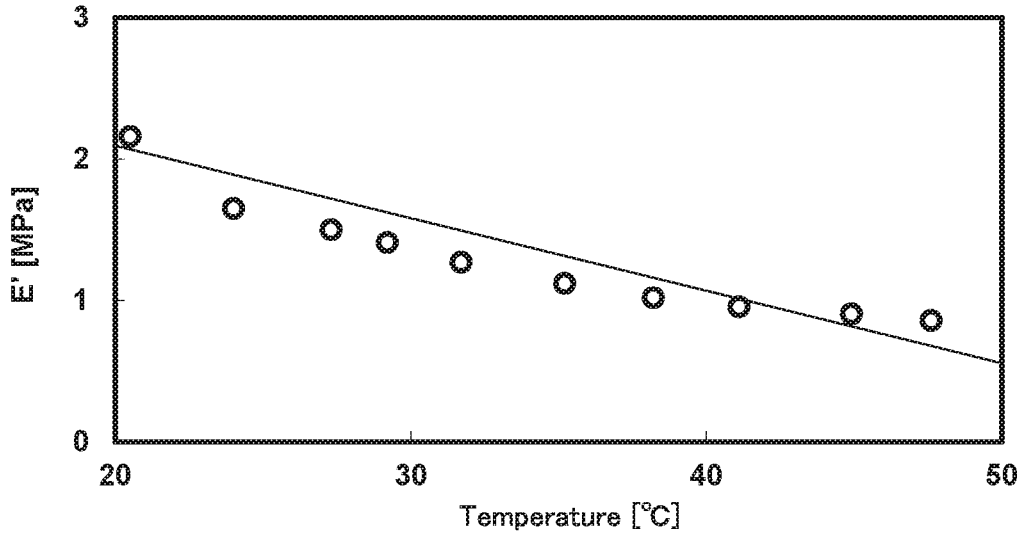

【Fig. 2A】
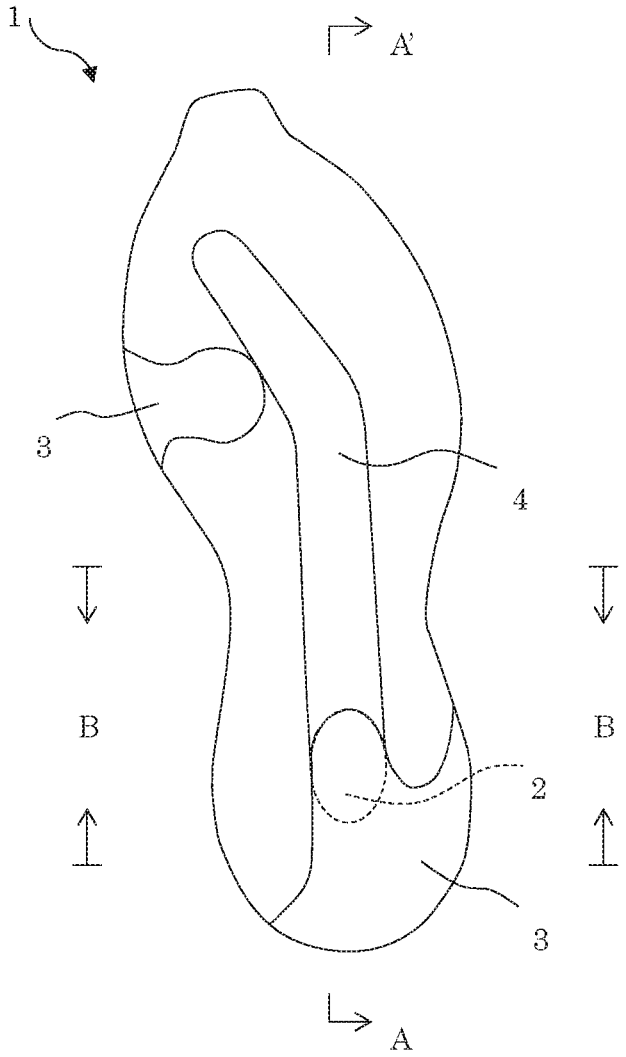
【Fig. 2B】
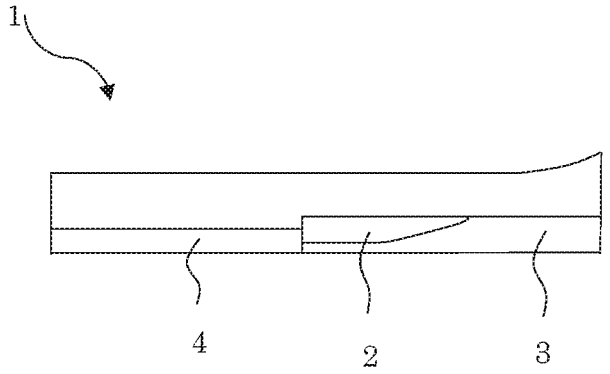

【Fig. 3A】
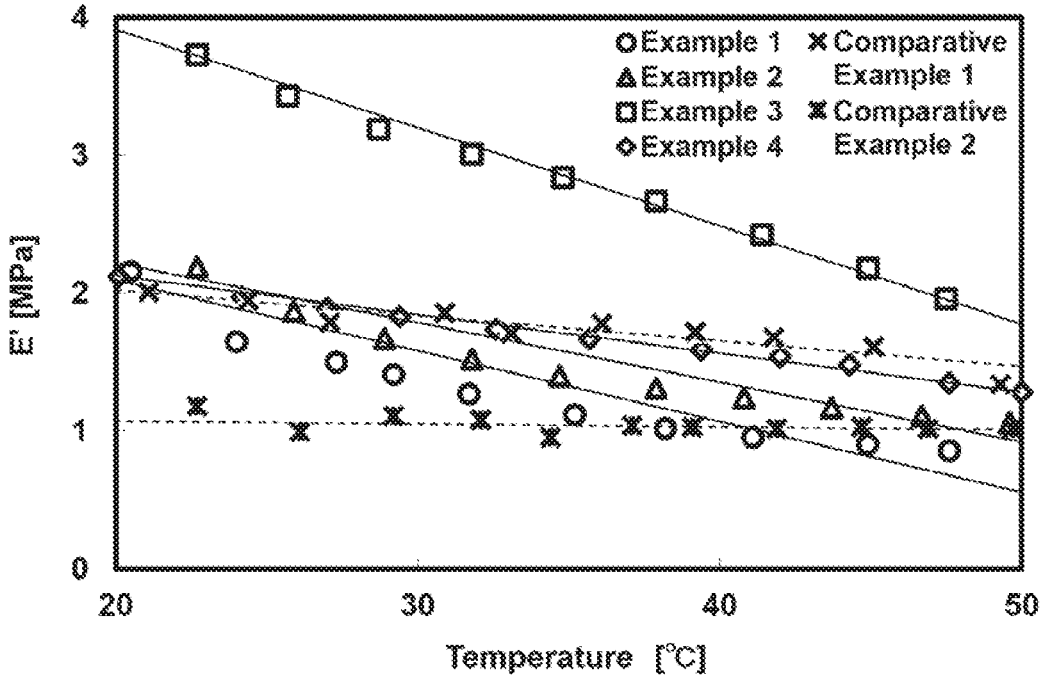
【Fig. 3B】
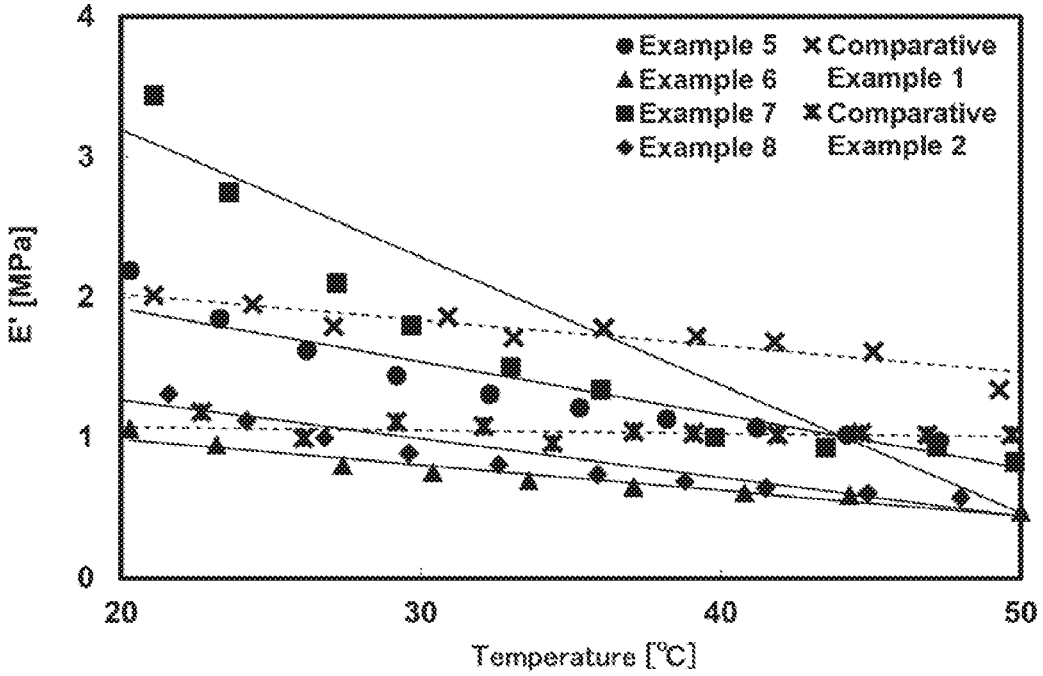

【Fig. 3C】
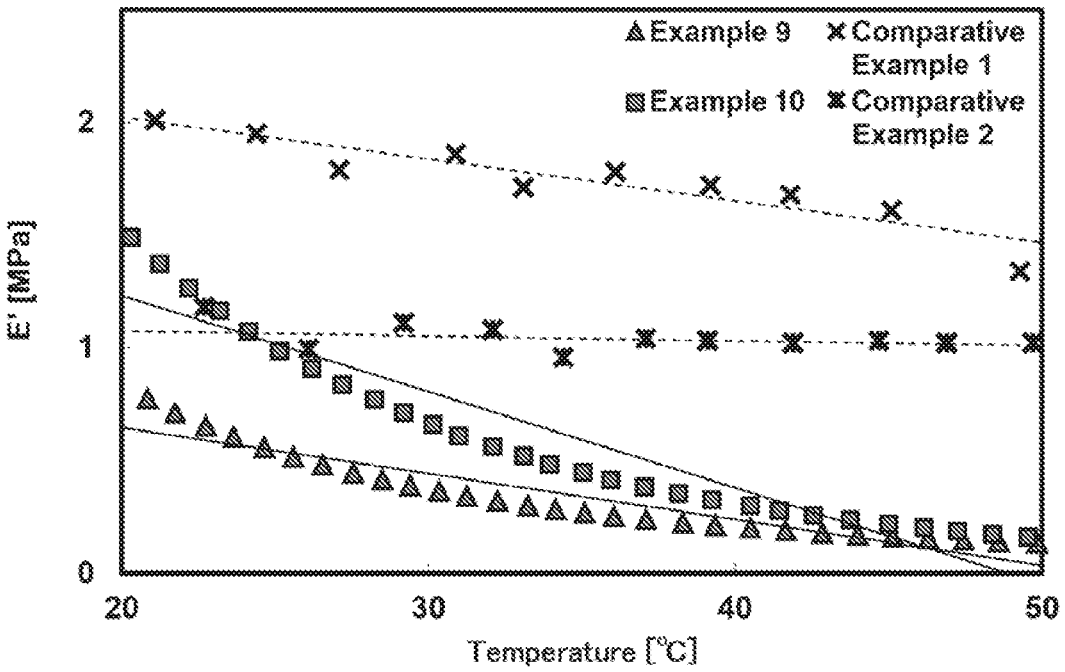
【Fig. 4】
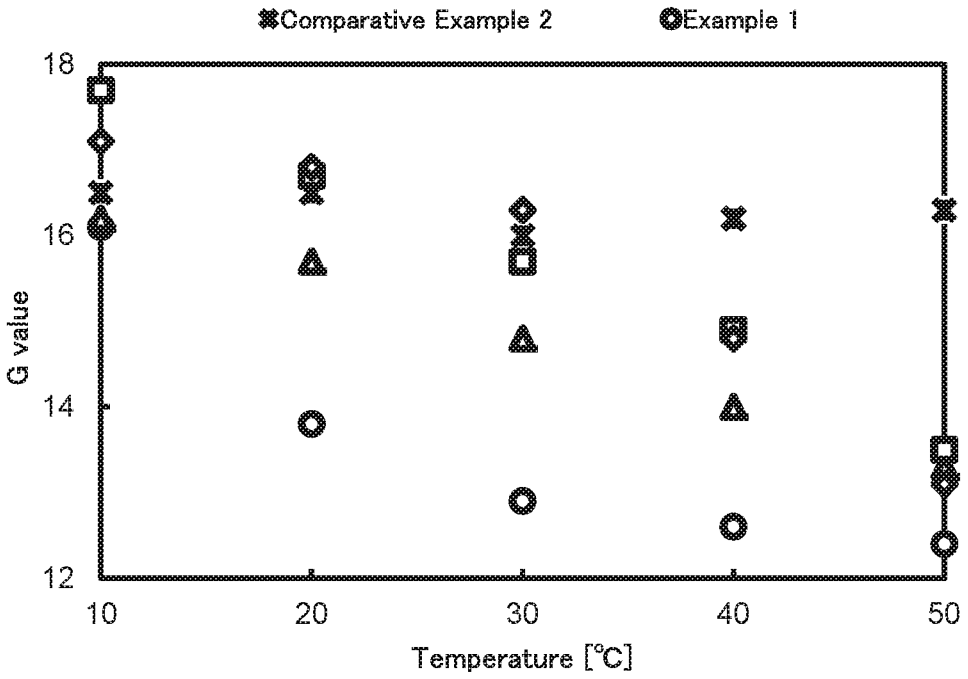

【Fig. 5】
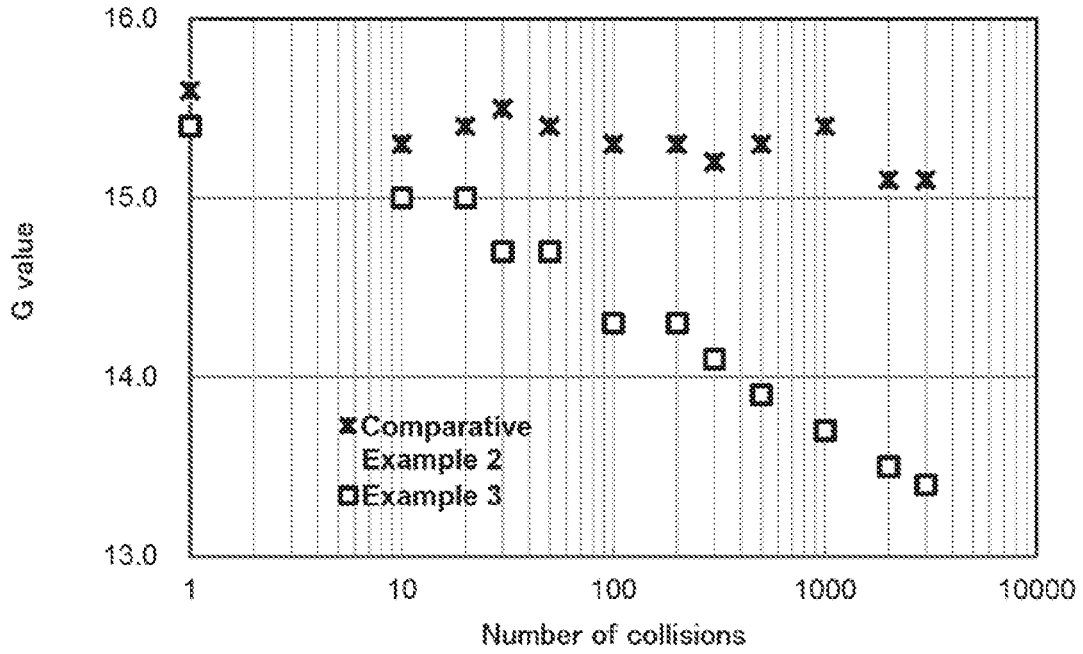
【Fig. 6】
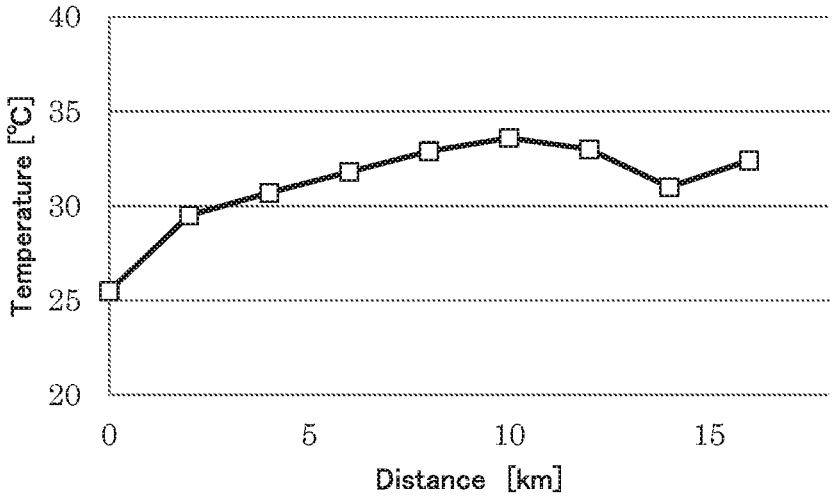

【Fig. 7A】
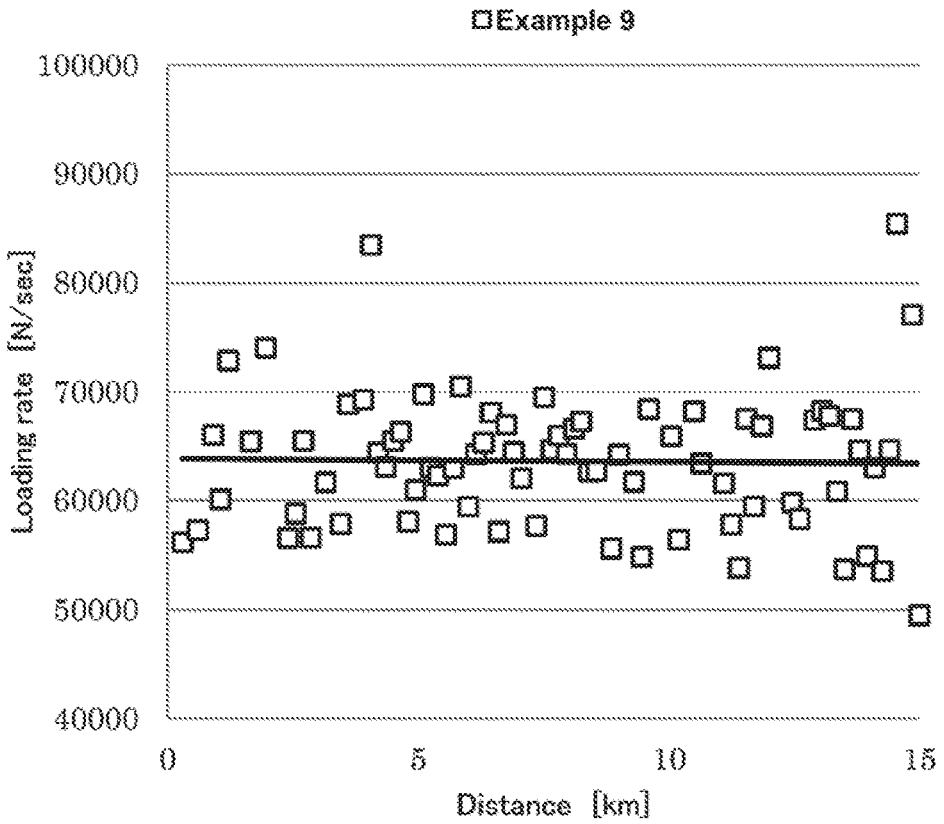
【Fig. 7B】
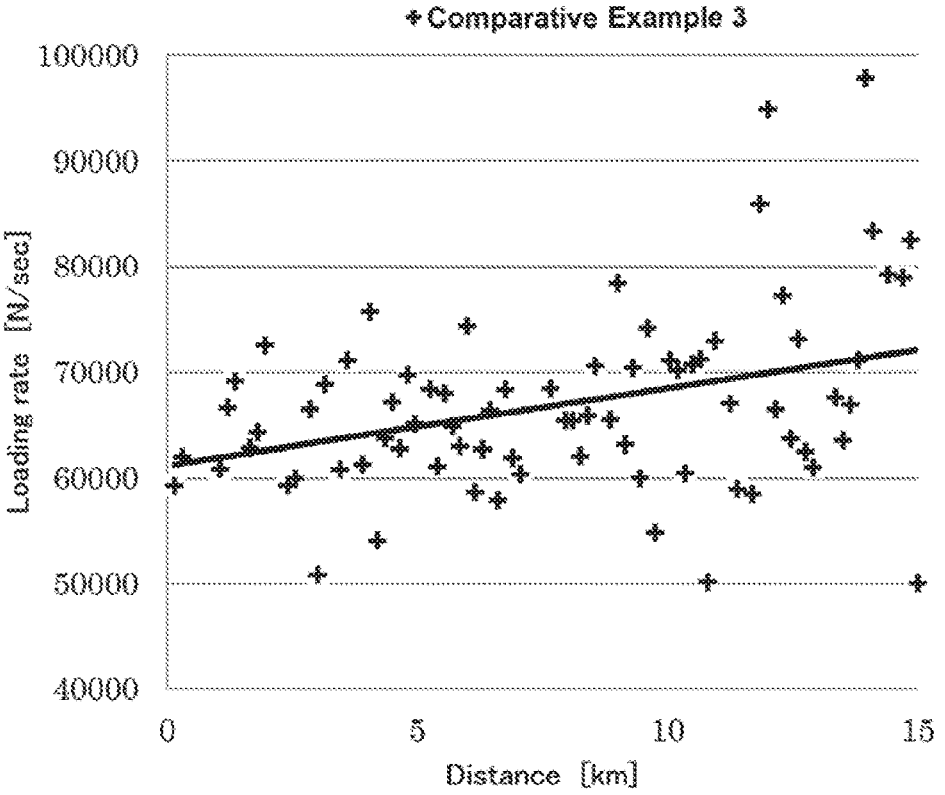

【Fig. 8】
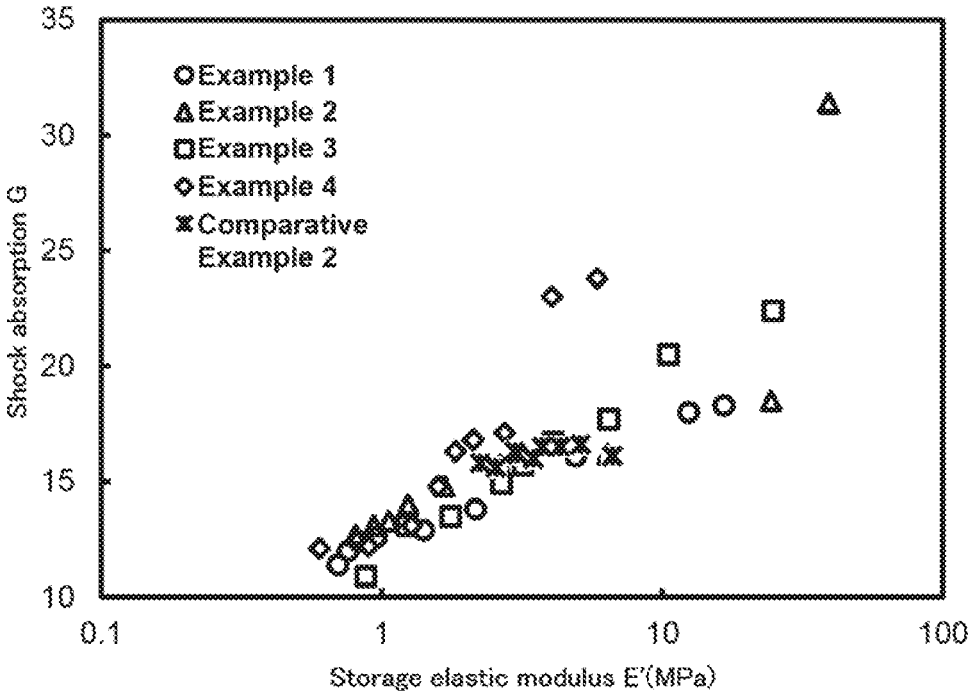

【Fig. 9A】
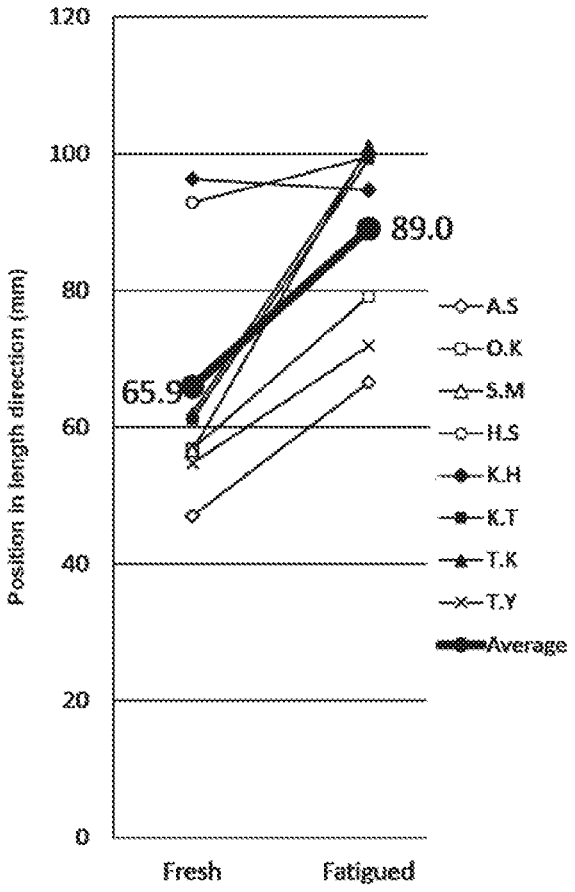

【Fig. 9B】
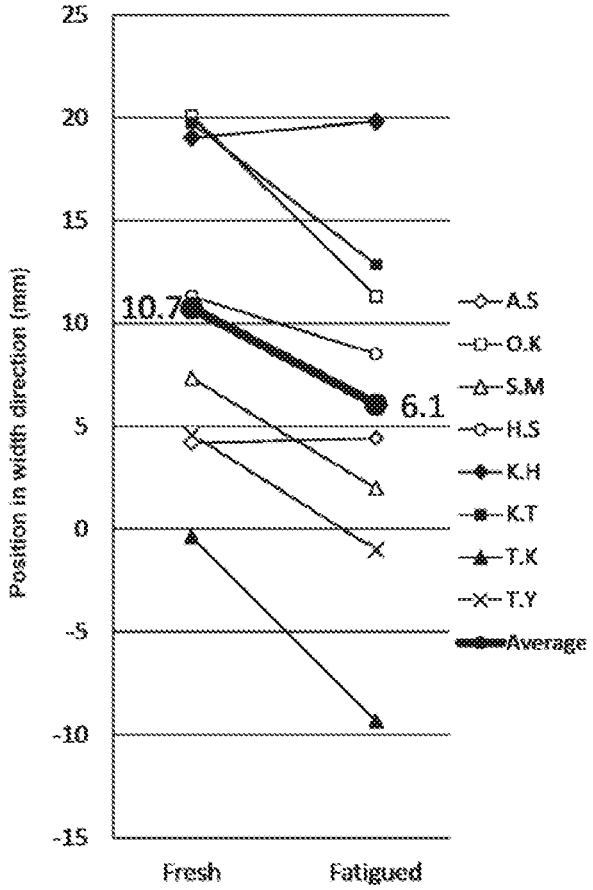

【Fig. 10】
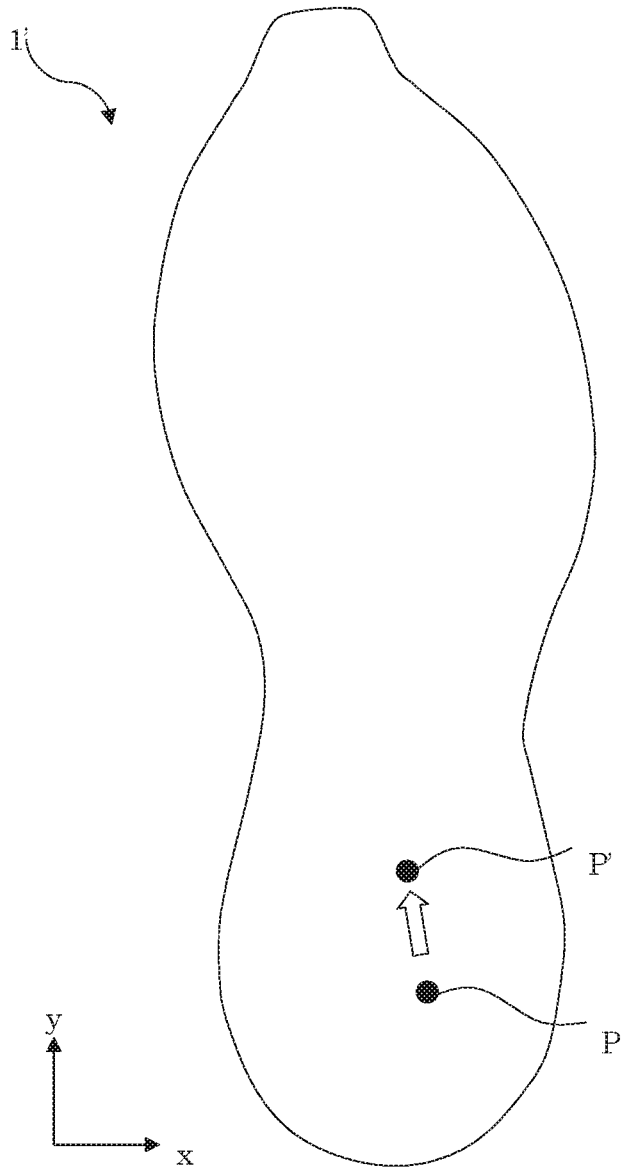

SHOCK ABSORBER AND SHOE SOLE

CROSS-REFERENCE TO RELATED APPLICATION

This application claims priority to International Patent Application No. PCT/JP2015/080787, the disclosure of which is incorporated herein by reference in its entirety.

FIELD

The present invention relates to a shock absorber and a shoe sole provided in a shoe.

BACKGROUND

In recent years, shoes are generally provided with shock absorbers for mitigating the shock caused by the collision between the ground and shoe soles. In particular, shock absorbers provided in running shoes are required to have a sufficient shock absorption for mitigating a strong shock generated during running. Meanwhile, if the shock absorption of the shock absorbers is excessively high, the energy loss during running increases, and further the stability during running may possibly be impaired in some cases. Therefore, shock absorbers provided in running shoes are required to have a shock absorption that is suitable for running.

It is known that the running form of a runner differs between in the early stage and in the last stage of long-distance running. Specifically, in the last stage of long-distance running in which the runner is tired, the stride length of the runner decreases as compared with that in the early stage of running. Therefore, the vertical loading rate applied to the feet of the runner increases, resulting in an increase in damage to the body of the runner.

In consideration of this fact, shoes for long-distance running are preferably provided with shock absorbers capable of sufficiently mitigating the damage to the runner in the last stage of long-distance running. However, if the shock absorption of shock absorbers is simply increased according to the load in the last stage of long-distance running, the shock absorption is rendered excessively high in the early stage of running, thereby causing a problem of the energy loss or the like. Therefore, for shoes for long-distance running, shock absorbers having a shock absorption that is higher in the last stage of long-distance running than in the early stage of running are required.

However, shock absorbers provided in shoes generally have a constant shock absorption in any stage of long-distance running, and there are few shock absorbers having a shock absorption that changes depending on the state of use.

As a shock absorber having a shock absorption that changes depending on the state of use, a shock absorber using a non-Newtonian fluid, which is disclosed in Patent Literature 1, is known, for example. The shock absorber has a shock absorption that changes corresponding to the shock transmitted from the feet during running. Specifically, the shock absorber exhibits characteristics of softening during walking and hardening during running.

However, the shock absorber of Patent Literature 1 does not consider the necessity of changes in shock absorption corresponding to running distance, and thus changes in shock absorption between in the early stage and in the last stage of long-distance running are insufficient. Therefore, both of a shock absorption required in the early stage of running and a shock absorption required in the last stage of long-distance running cannot be satisfied.

CITATION LIST

Patent Literature

Patent Literature 1: JP 2010-259811 A

SUMMARY

Technical Problem

In view of the aforementioned problems, it is an object of the present invention to provide a shock absorber provided in a shoe, the shock absorber having a shock absorption that changes corresponding to running distance so as to satisfy both of a shock absorption required in the early stage of long-distance running and a shock absorption required in the last stage of long-distance running, and to provide a shoe sole provided with such a shock absorber.

Solution to Problem

The inventors have focused on that a part of a shoe which repeatedly collides with the ground during running generates heat due to the energy of the collision. Further, the inventors have found that the shock absorber can exert shock absorption required in both of the early stage and the last stage of long-distance running by providing the shoe with a material having a shock absorption that increases with the temperature increase, thereby accomplishing the present invention.

That is, a shock absorber according to the present invention is formed by a resin composition and provided in a shoe, the shock absorber satisfying all formulas (1) to (4) below when changes in storage elastic modulus between 20° C. to 50° C. are linearly approximated by the least-squares method:

$$Y=aX+b \quad (1);$$

$$-0.1 \leq a \leq -0.02 \quad (2);$$

$$1.0 \leq b \leq 16.0 \quad (3); \text{ and}$$

$$R^2 \geq 0.75 \quad (4),$$

where X represents the temperature (unit: ° C.) of the shock absorber, Y represents the storage elastic modulus (unit: MPa) of the shock absorber, and R represents the correlation coefficient in the least-squares method.

Preferably, the shock absorber according to the present invention has a storage elastic modulus at 20° C. of 0.8 MPa or more and 4.0 MPa or less and a storage elastic modulus at 50° C. with respect to the storage elastic modulus at 20° C. of 1/11.0 to 1/1.6.

Preferably, the shock absorber according to the present invention has a storage elastic modulus at 20° C. of 1.0 MPa or more and 4.0 MPa or less and a storage elastic modulus at 50° C. with respect to the storage elastic modulus at 20° C. of 1/4.2 to 1/1.6.

Preferably, the shock absorber according to the present invention is provided at the heel of the shoe.

Preferably, the shock absorber according to the present invention is provided at a position corresponding to the medial process of the calcaneal tuberosity of a foot of a wearer when the shoe is worn.

Preferably, the shock absorber according to the present invention is provided in the range of 5% to 30% position in the length direction of the shoe sole and in the range of 20% to 80% position in the width direction of the shoe sole, when the position in the length direction of the shoe sole of the shoe at the heel-side end in the length direction is referred to as 0% position, the position at the toe-side end is referred to as 100% position, the position in the width direction orthogonal to the length direction of the shoe sole at the end on the inner foot side of the shoe is referred to as 0% position, and the position at the end on the outer foot side of the shoe is referred to as 100% position.

A shoe sole according to the present invention includes the aforementioned shock absorber.

BRIEF DESCRIPTION OF DRAWINGS

FIG. 1 is a graph showing the relationship between the temperature and the storage elastic modulus of a shock absorber according to an embodiment.

FIG. 2A is a schematic view showing a shoe sole provided with a shock absorber according to an embodiment.

FIG. 2B is a sectional view of the part B-B taken along the line A-A in FIG. 2A.

FIG. 3A is a graph showing the relationship between the temperature and the storage elastic modulus of shock absorbers according to Examples and Comparative Examples.

FIG. 3B is a graph showing the relationship between the temperature and the storage elastic modulus of shock absorbers according to Examples and Comparative Examples.

FIG. 3C is a graph showing the relationship between the temperature and the storage elastic modulus of shock absorbers according to Examples and Comparative Examples.

FIG. 4 is a graph showing the relationship between the temperature and the shock absorption of shock absorbers according to Examples and Comparative Examples.

FIG. 5 is a graph showing the relationship between the number of collisions and the shock absorption of shock absorbers according to Examples and Comparative Examples.

FIG. 6 is a graph showing temperature changes of a shock absorber during long-distance running in a shoe according to Example.

FIG. 7A is a graph showing the relationship between the running distance and the vertical loading rate to a foot of a wearer during long-distance running in the shoe according to Example.

FIG. 7B is a graph showing the relationship between the running distance and the vertical loading rate to a foot of a wearer during long-distance running in a shoe according to Comparative Example.

FIG. 8 is a graph showing the relationship between the storage elastic modulus and the shock absorption of shock absorbers in Reference Examples.

FIG. 9A is a graph showing the pressure center positions of the shoe soles in Reference Examples in the early stage and the last stage of long-distance running as positions in the length direction of the shoe soles.

FIG. 9B is a graph showing the pressure center positions of the shoe soles in Reference Examples in the early stage and the last stage of long-distance running as positions in the width direction of the shoe soles.

FIG. 10 is a view schematically showing a change in pressure center position of a shoe sole in Reference Examples between in the early stage and in the last stage of long-distance running.

DESCRIPTION OF EMBODIMENTS

Hereinafter, embodiments of a shock absorber and a shoe of the present invention will be described with reference to the drawings. The following embodiments are merely shown as examples. The present invention is not limited to the following embodiments at all.

(Shock Absorber)

First, the properties of the shock absorber of the present invention will be described in detail below.

The shock absorber of the present invention is formed by a resin composition and satisfies the following relationships, when changes in storage elastic modulus between 20° C. to 50° C. are linearly approximated by the least-squares method, as shown in FIG. 1:

$$Y=aX+b \quad (1);$$

$$-0.1 \leq a \leq -0.02 \quad (2);$$

$$1.0 \leq b \leq 16.0 \quad (3); \text{ and}$$

$$R^2 \geq 0.75 \quad (4),$$

where X represents the temperature (unit: ° C.) of the shock absorber, Y represents the storage elastic modulus (unit: MPa) of the shock absorber, and R represents the correlation coefficient in the least-squares method. In this description, the linear approximation by the least-squares method is performed by measuring the storage elastic modulus of the shock absorber at intervals of at least 5° C. from 20° C. to 50° C., and linearly approximating the changes in storage elastic modulus based on the storage elastic modulus obtained at each temperature by the least-squares method.

Since the shock absorber of the present invention satisfies the relationships of formulas (1) to (4) above, the shock absorption of the shock absorber when provided in a shoe changes corresponding to running distance so that both of a shock absorption required in the early stage of long-distance running and a shock absorption required in the last stage of long-distance running for shock absorbers provided in shoes are satisfied. This effect will be described below.

First, the shock absorber exhibits a sufficiently low storage elastic modulus in a temperature range of 20° C. to 50° C. Therefore, the shock absorber when provided in a shoe can effectively absorb the shock caused by the contact between the ground and the shoe during running. Further, the shock absorber has a feature that the storage elastic modulus decreases as the temperature increases. Generally, in long-distance running, the temperature of the shoe increases as the running distance increases due to the repeated contact between the ground and the shoe. That is, in the shoe provided with the shock absorber and worn in a long-distance running, the shock absorption of the shock absorber gradually increases as the running distance increases. That is, since the shock absorber of the present invention has comparatively low shock absorption in a low temperature region of the temperature range of 20° C. to 50° C., the stability is not impaired, and the energy loss during running is small while a sufficient shock absorption is exerted, in the early stage of running. Moreover, in a high temperature region of the temperature range, the shock absorption is comparatively high, and therefore the load on the human body increasing in the last stage of long-distance running can be absorbed more effectively. Accordingly, the shock absorber of the present invention can exert an ideal shock absorption in long-distance running.

The aforementioned value a represents the degree of decrease in storage elastic modulus corresponding to the temperature increase of the shock absorber. When the value a is greater than −0.02, the decrease of the storage elastic modulus with the temperature increase of the shock absorber is insufficient, and therefore there may be cases where the shock caused by the contact between the ground and the shoe in the last stage of long-distance running cannot be sufficiently absorbed. When the value a is smaller then −0.1, the difference in storage elastic modulus between in the early stage and in the last stage during long-distance running is excessively large, and there may be cases where the wearer cannot keep stable running.

The aforementioned value b represents the value of the storage elastic modulus of the shock absorber. When the value b is greater than 16.0, the shock absorber is excessively hard, and there may be cases where the shock absorption required for shoes cannot be exerted. When the value b is smaller than 1.0, the shock absorber is excessively soft, and there may be cases where the stability required for shoes is not sufficient. More preferably, the value b may be in the range of $1.0 \leq b \leq 5.5$.

Further, when the storage elastic modulus of the shock absorber provided in a shoe is excessively low, the shock absorber is pressed to the limit due to the shock during running, which may result in cases where the shock absorption cannot be sufficiently exerted. Therefore, in order to prevent an excessively low storage elastic modulus of the shock absorber, particularly, at high temperature, the values a and b need to fall within the numerical ranges of the present invention.

Preferably, the shock absorber of the present invention may have a storage elastic modulus at 20° C. of 0.8 MPa or more and 5.5 MPa or less. In such a case, the shock absorber when provided in a shoe has sufficient shock absorption and less energy loss due to an excessively high shock absorption at the start of running. That is, such a shock absorber can have a more suitable shock absorption at the start of running. More preferably, the storage elastic modulus of the shock absorber at 20° C. may be 1.0 MPa or more and may be 4.0 MPa or less.

Preferably, the shock absorber of the present invention may have a storage elastic modulus at 50° C. with respect to the storage elastic modulus at 20° C. of 1/11.0 to 1/1.6. In such a case, a sufficient shock absorption is exerted also on a tired foot in the last stage of long-distance running, so that the fatigue can be reduced more effectively. Further, the shock absorption does not excessively largely change due to the temperature changes of the shock absorber, and therefore uncomfortable feeling due to the difference in shock absorption between in the early stage and in the last stage of long-distance running can be reduced. Accordingly, such a shock absorber can have a more suitable shock absorption in the last stage of long-distance running. The storage elastic modulus of the shock absorber at 50° C. with respect to the storage elastic modulus at 20° C. is preferably 1/4.2 or more, further preferably 1/2.3 or more. Further, the storage elastic modulus of the shock absorber at 50° C. with respect to the storage elastic modulus at 20° C. is preferably 1/1.8 or less.

In this description, the storage elastic modulus of the shock absorber is a value obtained by measurement according to JIS K7244-4 (ISO 6721-4). More specifically, the storage elastic modulus is a value obtained by measurement under conditions that are described in EXAMPLES, which will be described below.

The resin composition that forms the shock absorber of the present invention is not specifically limited, but styrene resins, urethane resins, acrylic resins, or epoxy resins are preferable. Examples of the styrene resins may include styrene-ethylene-butylene-styrene block copolymer (SEBS), styrene-butadiene-butylene-styrene block copolymer (SBBS), hydrogenated polystyrene-poly(styrene-butadiene)-polystyrene (SSEBS), styrene-butylene-styrene block copolymer (SBS), styrene-isoprene block copolymer (SIS), and styrene-ethylene-propylene-styrene block copolymer (SEPS), where SEBS, SSEBS, and SIS are more preferable. Examples of the urethane resins may include thermoplastic urethanes and thermosetting urethanes, where thermoplastic urethanes are more preferable. Further, the resin composition may be acrylic or epoxy ultraviolet curable resins, for example. These resins may be used individually, or two or more of them may be used in combination.

In the case where the resin composition contains styrene resins, the balance of the cushioning properties and the rigidity of the shock absorber formed by the resin composition can be adjusted to a range that is suitable as a shoe sole member by appropriate adjustment of the content of styrene components contained in the styrene resins (styrene content). Preferably, the styrene content of the resin composition is 10 to 40 wt %. In this case, the degree of decrease in storage elastic modulus (the value a in formula (1) above) corresponding to the temperature increase of the shock absorber is easily set to the aforementioned suitable range.

More preferably, the resin composition may be an uncrosslinked block copolymer obtained by mixing SEBS, SSEBS, and SIS in any combination.

Further, the resin composition may be crosslinked or uncrosslinked, or foamed or unfoamed. If the resin composition is a foam, the structural elasticity of the resin composition may be lost once cell walls of the foam are buckled. Therefore, the resin composition is preferably unfoamed.

The shock absorber of the present invention is not specifically limited as long as it has such a storage elastic modulus as described above, but is preferably a gel material having excellent shock cushioning properties. The gel material is obtained by gelation of the resin composition and may further contain a plasticizer. Examples of the plasticizer include paraffin, naphthene, aromatic, and olefin plasticizers, and paraffin plasticizers are more preferable.

Further, the shock absorber of the present invention may further contain a temperature-responsive dye (chromic dye). In this case, the color of the temperature-responsive dye contained in the shock absorber changes with the temperature increase of the shock absorber, and therefore the change in the shock absorption can be visually checked. The temperature-responsive dye is a dye having a color that changes corresponding to temperature changes. Examples of the temperature-responsive dye may include inorganic materials such as liquid crystal or organic compounds including leuco dye, spiropyran, salicylideneaniline, polydiacetylene, or the like.

Further, the shock absorber of the present invention may further contain an anti-adhesive agent other than above.

(Shoe Sole)

The shock absorber of the present invention is provided in a shoe for use. Hereinafter, a preferable embodiment of a shoe using the shock absorber of the present invention will be described.

FIG. 2A and FIG. 2B show a shoe sole 1 of a shoe of this embodiment which is provided with the shock absorber. In this embodiment, the shoe sole 1 is a midsole of the shoe.

The shoe sole 1 is provided with a shock absorber 2 in a heel part. Generally, the shoe lands from the heel during running, and therefore the shock due to the contact between the ground and the shoe during running is mainly applied to the heel part of the shoe sole. Therefore, the shock upon landing can be effectively absorbed by providing the shock absorber 2 in the heel part of the shoe sole, so that the foot of the wearer can be suitably protected.

Preferably, the shock absorber 2 may be provided at a position corresponding to a portion from the calcaneus to the vicinity of the midfoot of the foot of the wearer. More preferably, the shock absorber 2 may be provided at a position corresponding to a portion from the calcaneal tuberosity to the vicinity of the tarsometatarsal joint of the foot of the wearer. Further preferably, the shock absorber 2 may be provided at a position corresponding to a portion from the calcaneal tuberosity to the vicinity of the transverse tarsal joint of the foot of the wearer.

Specifically, the shock absorber 2 is preferably provided in any area in the range of 5% position to 30% position in the length direction of the shoe sole 1, when the position in the length direction of the shoe sole 1 of the shoe at the heel-side end in the length direction is referred to as 0% position, and the position at the toe-side end is referred to as 100% position. Further, the shock absorber 2 is preferably provided in any area in the range of 20% to 80% position in the width direction of the shoe sole 1, when the position in the width direction orthogonal to the length direction of the shoe sole 1 at the end on the inner foot side of the shoe is referred to as 0% position, and the position at the end on the outer foot side of the shoe is referred to as 100% position. More preferably, the shock absorber 2 may be provided in any area in the range of 5% to 30% position in the length direction of the shoe sole 1 and may be provided in any area in the range of 20% to 80% position in the width direction of the shoe sole 1.

In this embodiment, the shock absorber 2 is provided at a position corresponding to the medial process of the calcaneal tuberosity of the foot of the wearer. Generally, the load center position (pressure center position) at the time when the largest load is applied due to the collision between the ground and the shoe during running shifts from the calcaneal tuberosity to the position immediately below the vicinity of the transverse tarsal joint during long-distance running, with changes in the running form of the wearer due to fatigue. At this time, in the case where the shock absorber 2 is provided at a position corresponding to the medial process of the calcaneal tuberosity, the shock absorber 2 is provided at a position close to the pressure center position at the time when the largest load is applied throughout from the early stage to the last stage of long-distance running. Therefore, the properties of the shock absorber 2 that the shock absorption changes corresponding to running distance can be exerted more effectively. Accordingly, in this embodiment, the shock absorber 2 can exert an excellent shock absorption throughout from the early stage to the last stage of long-distance running.

Further preferably, the shock absorber 2 may be provided in a range covering the pressure center position any time from the early stage to the last stage of long-distance running. Examples thereof include a case where the shock absorber 2 is provided in the entire area corresponding to a portion from the calcaneal tuberosity to the transverse tarsal joint of the foot of the wearer. Further, the shock absorber 2 may be provided entirely in the range of 5% to 30% position in the length direction of the shoe sole 1 and the range of 20% to 80% position in the width direction of the shoe sole 1.

The shock absorber 2 needs only to be provided at a position at which the shock absorber 2 can absorb the shock generated upon landing of the shoe and is not necessarily provided in the heel part of the shoe. For example, the shock absorber 2 may be provided at a position corresponding to the thenar of the foot of the wearer.

The thickness of the shock absorber 2 is not specifically limited but is preferably 3 mm or more. If the thickness of the shock absorber 2 is excessively small, the shock absorber 2 may be pressed to the limit due to the shock during running when the storage elastic modulus of the shock absorber 2 has decreased in the last stage of long-distance running, which may result in failure to sufficiently exert the shock absorption.

The planar shape of the shock absorber 2 is not specifically limited and may be circular, elliptical, rectangular, or polygonal, for example. Preferably, the planar shape of the shock absorber 2 may be circular or elliptical.

The shoe sole 1 according to this embodiment includes a gel material 3 in a wide area of the heel part. Specifically, the gel material 3 is provided so as to be stacked on a part of the shock absorber 2 from the side on which the shoe sole faces the ground and to expand from the vicinity of the center of the shock absorber 2 toward the heel-side end of the shoe sole. As described above, the gel material 3 covers the shock absorber 2 from the ground side in the shoe sole 1 of this embodiment. Thereby, the shock absorber 2 is less likely to be exposed to the outside air, and therefore the shock absorber 2 is less likely to be affected by the outdoor air temperature. Therefore, the temperature of the shock absorber 2 can stably increase according to the running distance due to the collision between the ground and the shoe during running without being affected by the outdoor air temperature so much. In addition, also in the early stage of running, the temperature of the shock absorber 2 does not decrease excessively due to the influence of the outdoor air temperature. Therefore, the shock absorber 2 can exert a sufficient shock absorption from the early stage of running, while not excessively hardening.

In this embodiment, the gel material 3 completely covers the shock absorber 2, but the gel material 3 may cover only a part of the shock absorber 2. Further, a material that is different from the gel material 3 may partially or completely cover the shock absorber 2. Examples of the material that can partially or completely cover the shock absorber 2 include gel materials mainly containing styrene, urethane, or silicon, resin materials such as polyurethane, polyamide, and ethylene-vinyl acetate copolymer, rubber materials such as natural rubber (NR), butadiene rubber (BR), isoprene rubber (IR), and styrene-butadiene rubber (SBR), and sponge materials obtained by foaming resin materials by chemical or physical methods. Further, it is also possible that the gel material 3 of the shoe sole 1 does not cover the shock absorber 2 at all. Of course, the shoe sole 1 may optionally include the gel material 3 and may be free from the gel material 3.

The shoe sole 1 according to this embodiment further includes the gel material 3 at a position corresponding to the thenar of the foot of the wearer. In this way, the shoe provided with the shock absorber of the present invention may include a material having a shock absorption at this position. Further, as described above, the shock absorber 2 may be provided at this position.

Further, the shoe sole 1 according to this embodiment includes a foam material 4 that extends from the position where the shock absorber 2 is provided toward the toe side of the shoe sole. In this way, when the shock absorber of the present invention is provided in a shoe, a foam material may be used in combination.

In this embodiment, the shock absorber 2 is provided in the shoe sole 1 that is the midsole, but the shoe sole 1 may be the inner sole or may be the outer sole. That is, the shock absorber of the present invention may be provided in the inner sole, the midsole, or the outer sole.

As described above, the shock absorber of this embodiment configured as above thus has the following advantages.

The shock absorber of this embodiment is formed by a resin composition and is provided in a shoe, and the shock absorber satisfies all formulas (1) to (4) below when changes in storage elastic modulus between 20° C. to 50° C. are linearly approximated by the least-squares method:

$$Y=aX+b \quad (1);$$

$$-0.1 \leq a \leq -0.02 \quad (2);$$

$$1.0 \leq b \leq 16.0 \quad (3); \text{ and}$$

$$R^2 \geq 0.75 \quad (4),$$

where X represents the temperature (unit: ° C.) of the shock absorber, Y represents the storage elastic modulus (unit: MPa) of the shock absorber, and R represents the correlation coefficient in the least-squares method.

According to such a configuration, the shock absorption of the shock absorber of this embodiment when provided in a shoe can change corresponding to running distance so that both of a shock absorption required in the early stage of long-distance running and a shock absorption required in the last stage of long-distance running for shock absorbers provided in shoes are satisfied.

Preferably, the shock absorber of this embodiment has a storage elastic modulus at 20° C. of 0.8 MPa or more and 5.5 MPa or less and a storage elastic modulus at 50° C. with respect to the storage elastic modulus at 20° C. of 1/11.0 to 1/1.6. In such a case, the shock due to the collision between the ground and the shoe can be absorbed more efficiently throughout from the early stage to the last stage of long-distance running. More preferably, the shock absorber of this embodiment has a storage elastic modulus at 20° C. of 1.0 MPa or more and 5.5 MPa or less and a storage elastic modulus at 50° C. with respect to the storage elastic modulus at 20° C. of 1/4.2 to 1/1.6.

Preferably, the shock absorber of this embodiment is provided at the heel of the shoe. In this case, the shock due to the collision between the ground and the shoe can be absorbed more efficiently.

Preferably, the shock absorber of this embodiment is provided at a position corresponding to the medial process of the calcaneal tuberosity of a foot of the wearer. In such a case, the shock due to the collision between the ground and the shoe can be absorbed more efficiently throughout from the early stage to the last stage of long-distance running.

Preferably, the shock absorber of this embodiment is provided in the range of 5% to 30% position in the length direction of the shoe sole and in the range of 20% to 80% position in the width direction of the shoe sole, when the position in the length direction of the shoe sole of the shoe at the heel-side end in the length direction is referred to as 0% position, the position at the toe-side end is referred to as 100% position, the position in the width direction orthogonal to the length direction of the shoe sole at the end on the inner foot side of the shoe is referred to as 0% position, and the position at the end on the outer foot side of the shoe is referred to as 100% position. In this case, the shock due to the collision between the ground and the shoe can be absorbed further efficiently throughout from the early stage to the last stage of long-distance running.

The shoe sole of this embodiment includes the aforementioned shock absorber. Therefore, the shoe sole of this embodiment when provided in a shoe can efficiently absorb the shock due to the collision between the ground and the shoe throughout from the early stage to the last stage of long-distance running.

EXAMPLES

Hereinafter, the present invention will be clarified by way of specific examples and comparative examples of the present invention. The present invention is not limited to the following examples.

(Shock Absorber)

The following raw materials were used for producing shock absorbers of Examples 1 to 10.

SSEBS having the tan δ peak at 10° C. to 30° C. . . . Raw material 1

SEBS having the tan δ peak at 100° C. to 120° C. . . . Raw material 2

SIS having the tan δ peak at 10° C. to 30° C. . . . Raw material 3

SEEPS having a weight-average molecular weight (Mw) of 100,000 or more . . . Raw material 4

Paraffin hydrocarbon lubricating oil . . . Raw material 5

Acrylic resin having the tan δ peak at 0° C. to 20° C. . . . Raw material 6

Acrylic resin having the tan δ peak at 50° C. to 70° C. . . . Raw material 7

Further, the styrene content of shock absorbers of Examples 1 to 8 and Comparative Example 2 was calculated based on the styrene content of the raw materials and the mixing ratio of the raw materials.

Example 1

A shock absorber of Example 1 was produced by mixing raw material 1, raw material 2, raw material 4, and raw material 5 at a weight ratio of 30:5:15:50. Specifically, these raw materials were introduced into a "twin screw kneading extruder" manufactured by TECHNOVEL CORPORATION, followed by kneading at 200° C. for pelletization and thereafter injection molding, to obtain the shock absorber of Example 1. The styrene content of the shock absorber obtained was 27.6%.

Example 2

A shock absorber of Example 2 was produced by mixing raw material 1, raw material 2, raw material 4, and raw material 5 at a weight ratio of 15:20:15:50 in the same manner as in Example 1. The styrene content of the shock absorber obtained was 22.1%.

Example 3

A shock absorber of Example 3 was produced by mixing raw material 1, raw material 2, raw material 4, and raw material 5 at a weight ratio of 30:30:5:35 in the same manner as in Example 1. The styrene content of the shock absorber obtained was 31.1%.

Example 4

A shock absorber of Example 4 was produced by mixing raw material 1, raw material 2, and raw material 5 at a weight ratio of 30:30:40 in the same manner as in Example 1. The styrene content of the shock absorber obtained was 29.1%.

Example 5

A shock absorber of Example 5 was produced by mixing raw material 1, raw material 2, raw material 4, and raw material 5 at a weight ratio of 28:28:4:40 in the same manner as in Example 1. The styrene content of the shock absorber obtained was 28.8%.

Example 6

A shock absorber of Example 6 was produced by mixing raw material 3 and raw material 5 at a weight ratio of 65:35 in the same manner as in Example 1. The styrene content of the shock absorber obtained was 13.0%.

Example 7

A shock absorber of Example 7 was produced by mixing raw material 1, raw material 3, and raw material 5 at a weight ratio of 30:35:35 in the same manner as in Example 1. The styrene content of the shock absorber obtained was 27.1%.

Example 8

A shock absorber of Example 8 was produced by mixing raw material 1, raw material 3, and raw material 5 at a weight ratio of 26:31:43 in the same manner as in Example 1. The styrene content of the shock absorber obtained was 23.6%.

Example 9

A shock absorber of Example 9 was produced using raw material 6 as a single material. Specifically, this raw material was injected into a plastic mold, followed by irradiation with ultraviolet rays, to obtain the shock absorber of Example 9.

Example 10

A shock absorber of Example 10 was produced using raw material 7 as a single material in the same manner as in Example 9.

Comparative Example 1

A shock absorber "BROOKS DNA (registered trademark)" used in the shoe soles of shoes "Glycerin 8" (2010 model), manufactured by Brooks Sports, Inc., was taken out of the shoes, to serve as the shock absorber of Comparative Example 1.

Comparative Example 2

A shock absorber of Comparative Example 2 was produced by mixing raw material 2 and raw material 5 at a weight ratio of 55:45 in the same manner as in Example 1. The styrene content of the shock absorber obtained was 16.5%.

Storage Elastic Modulus in Temperature Range of 20 to 50° C.

The storage elastic modulus of the shock absorbers of Examples 1 to 10 and Comparative Examples 1 and 2 in the temperature range of 20 to 50° C. was obtained as follows. First, a shock absorber to be measured was cut to a size of 30 mm×5 mm×2 mm, and the storage elastic modulus of the shock absorber was measured using a "dynamic viscoelasticity measuring instrument Rheogel-E Series" manufactured by UBM as a measuring device under the following conditions by a test according to JIS K7244-4.

Mode: Frequency and temperature dependence
Frequency: 10 Hz
Measured temperature range: −40° C. to 140° C.
Step temperature: 3° C.
Heating rate: 2° C./min
Measuring jig: Tension
Distortion amount: 0.025%
Distorted waveform: Sine wave FIG. 3A to FIG. 3C show the storage elastic moduli in the temperature range of 20 to 50° C. of the measured shock absorbers and lines obtained by approximating changes in storage elastic moduli between 20° C. to 50° C. by the least-squares method. Among these, Table 1 below shows the storage elastic moduli at 20° C. (E'20) of the measured shock absorbers, the storage elastic moduli at 50° C. (E'50) thereof, and the ratios thereof.

TABLE 1

| | Example 1 | Example 2 | Example 3 | Example 4 | Example 5 | Example 6 |
|---|---|---|---|---|---|---|
| E'20 | 2.160 | 2.640 | 4.080 | 2.120 | 2.190 | 1.060 |
| E'50 | 0.834 | 1.060 | 1.760 | 1.280 | 0.935 | 0.469 |
| E'20/E'50 | 2.590 | 2.491 | 2.318 | 1.656 | 2.342 | 2.260 |
| | Example 7 | Example 8 | Example 9 | Example 10 | Comparative Example 1 | Comparative Example 2 |
| E'20 | 3.440 | 1.500 | 0.844 | 1.623 | 2.010 | 1.010 |
| E'50 | 0.826 | 0.547 | 0.129 | 0.149 | 1.340 | 1.020 |
| E'20/E'50 | 4.165 | 2.742 | 6.557 | 10.896 | 1.500 | 0.990 |

Further, the following shows the formulas used for the linear approximation by the least-squares method in FIG. 3A to FIG. 3C, where X represents the temperature (unit: ° C.) of the shock absorber, Y represents the storage elastic modulus of the shock absorber, and R represents the correlation coefficient in the least-squares method.

Example 1: $Y=-0.0513X+3.1208$, $R^2=0.8080$
Example 2: $Y=-0.0432X+3.0820$, $R^2=0.8679$
Example 3: $Y=-0.0715X+5.3431$, $R^2=0.9914$
Example 4: $Y=-0.0281X+2.6881$, $R^2=0.9853$
Example 5: $Y=-0.0459X+2.9980$, $R^2=0.8521$
Example 6: $Y=-0.0332X+1.9155$, $R^2=0.7654$
Example 7: $Y=-0.0910X+5.0153$, $R^2=0.8108$
Example 8: $Y=-0.0276X+1.8181$, $R^2=0.8794$ Example 9: $Y=-0.0427X+2.0861$, $R^2=0.8861$
Example 10: $Y=-0.0203X+1.0532$, $R^2=0.8668$
Comparative Example 1: $Y=-0.0185X+2.3941$, $R^2=0.9060$
Comparative Example 2: $Y=-0.0021X+1.1155$, $R^2=0.1522$ As is obvious from FIG. 3A to FIG. 3C, it is understood that the shock absorbers of Examples 1 to 10 according to the present invention satisfy all formulas (1) to (4) above when changes in storage elastic modulus between 20° C. to 50° C. are linearly approximated by the least-squares method. In contrast, it is understood that both the shock absorbers of Comparative Examples 1 and 2 do not satisfy formula (2) above, and changes in storage elastic modulus between 20° C. to 50° C. are insufficient.

Shock Absorption in Temperature Range of 20 to 50° C.

The shock absorption in the temperature range of 20 to 50° C. of the shock absorbers of Examples 1 to 4 and Comparative Example 2 was examined by the following rigid body drop test. First, a shock absorber to be measured was cut into a circular shape of 50-mm diameter×20-mm thickness, and the temperature was set to 20° C., 30° C., 40° C., or 50° C. Next, 10 kg of spherical rigid body was perpendicularly dropped onto the shock absorber from a height of 50 mm, thereby allowing the rigid body to collide with the shock absorber. During this time, the acceleration of the rigid body was measured, and the maximum acceleration as measured was divided by the gravitational acceleration (9.80665 $m/s^2$), to measure a G value applied to the rigid body. The smaller the G value, the smaller the shock applied to the rigid body, which indicates that the shock absorption of the shock absorber measured is higher. Thus, the G value of each shock absorber was measured at a temperature of 20° C., 30° C., 40° C., or 50° C. FIG. 4 shows the G value of each shock absorber measured at each temperature.

As is obvious from FIG. 4, it is understood that, in the shock absorbers of Examples 1 to 4 according to the present invention, the G value applied to the rigid body in the rigid body drop test significantly decreases in the temperature range of 20° C. to 50° C. That is, it is understood that the shock absorption of these shock absorbers significantly increases as the temperature increases. In contrast, it is understood that, in the shock absorber of Comparative Example 2, the G value applied to the rigid body changes little, that is, the shock absorption changes little in the temperature range of 20° C. to 50° C., even if the temperature increases.

Changes in Shock Absorption Corresponding to the Number of Collisions

For the shock absorbers of Example 3 and Comparative Example 2, the relationship between the number of collisions and the shock absorption was examined by repeatedly performing the rigid body drop test. FIG. 5 shows the relationship between the G value of each shock absorber as measured and the number of collisions of the rigid body.

As is obvious from FIG. 5, it is understood that, in the shock absorber of Example 3 according to the present invention, the G value applied to the rigid body in collisions significantly decreases, that is, the shock absorption significantly increases, as the number of collisions of the rigid body increases. This result indicates that the temperature of the shock absorber increases by repeating the collision between the shock absorber and the rigid body. In contrast, it is understood that, in the shock absorber of Comparative Example 2, the G value changes little, that is, the shock absorption changes little, even if the number of collisions of the rigid body increases.

(Shoe Provided with Shock Absorber)

Example 11

A shoe provided with the shoe sole shown in FIG. 2 as the midsole was produced using the shock absorber obtained by Example 3. Specifically, the shoe includes a midsole (the shoe sole 1) shown in FIG. 2 containing the following materials and an outer sole containing the following material.

Midsole

Shock absorber 2: A shock absorber obtained by Example 3

Gel material 3: A gel material mainly containing a styrene polymer

Foam material 4: A foam mainly containing an olefin polymer

Outer Sole: A Rubber Material Mainly Containing BR

Here, the shock absorber 2 provided in the midsole of the shoe is substantially circular and is provided in the range of 5% to 20% position in the length direction of the midsole and in the range of 20% to 80% position in the width direction of the midsole.

Comparative Example 3

A shoe of Comparative Example 3 was produced in the same manner as in Example 11 except that the shock absorber 2 was composed of a gel material mainly containing a styrene polymer.

Temperature Changes of Shock Absorber During Long-Distance Running

Changes in internal temperature of the shock absorber provided in the shoe of Example 11 during long-distance running with the shoe worn were measured by the following method. A 15-km run on an asphalt road at an almost constant speed of 6 minutes/km was performed, with the shoe of Example 11 worn, under conditions of an atmospheric temperature of 21° C. and a humidity of 65%. During the running, the internal temperature of the shock absorber provided in the shoe was measured every 2 km from the start of running, using a temperature sensor "540E MD-5" manufactured by Anritsu Meter Co., Ltd. FIG. 6 shows the measurement results.

As is obvious from FIG. 6, it is understood that, as a result of running kept with the shoe worn, the internal temperature of the shock absorber provided in the shoe increases as the running time increases. Thereby, it is understood that the shock absorption of the shock absorber provided in the shoe increases as the running time increases.

Effect of Shock Absorber on Running

The relationship between the running distance and the vertical loading rate on the foot of the wearer during long-distance running with each of the shoes of Example 11 and Comparative Example 3 worn was examined by the following method. A 15-km run on an asphalt road at an almost constant speed of 6 minutes/km was performed, with the shoe to be measured worn, under conditions of an atmospheric temperature of 21° C. and a humidity of 65%. During the running, the ground reaction force at the collision between the shoe and the ground was measured every 150-m run using "Force Plate 9278A" manufactured by Kistler Group, and the vertical loading rate on the foot of the wearer was calculated from the ground reaction force. FIG. 7 A and FIG. 7B show a loading rate corresponding to the running distance and a line obtained by approximating changes in the loading rate corresponding to running distance by the least-squares method, when each of the shoes is worn.

As is obvious from FIG. 7 A and FIG. 7B, it is understood that, in the case of running kept with the shoe of Example 11 according to the present invention worn, the loading rate changes little even if the running distance increases. Therefore, it is understood that there is little difference in load on the foot of the wearer of the shoe between in the early stage and in the last stage of long-distance running. Accordingly, it is indicated that the shoe of Example 11 constantly has a suitable shock absorption throughout from the early stage to the last stage of long-distance running. In contrast, it is understood that, in the case of running kept with the shoe of Comparative Example 3 worn, the loading rate gradually increases as the running distance increases. Therefore, it is understood that the load on the foot of the wearer of the shoe increases toward the last stage of long-distance running.

Reference Examples

Verification of Correlation Between Elastic Modulus and Shock Absorption

Using the shock absorbers of Examples 1 to 3 and Comparative Example 2, the relationship between the storage elastic modulus and the shock absorption of the shock absorbers was verified by the following method. A shock absorber to be measured was set to a plurality of different optional temperatures, and thereafter the storage elastic modulus and the shock absorption (G value applied to the rigid body) of the shock absorbers were measured in the same manner as above. FIG. 8 shows the relationship between the storage elastic modulus and the shock absorption determined for each of the shock absorbers.

As is obvious from FIG. 8, it is understood that there is a positive correlation between the elastic modulus and the G value. Accordingly, it is understood that, the smaller the elastic modulus of the shock absorber, the smaller the G value, that is, the shock absorption increases.

Measurement of Changes in Pressure Center Position During Long-Distance Running

Using a common shoe, the load center position (pressure center position) in the shoe sole at the time when the largest load was applied due to the collision between the ground and the shoe during running was calculated using the force plate manufactured by Kistler Group in the early stage and the last stage of long-distance running, and changes in the coordinates were investigated. The coordinates of the pressure center position were determined by the following calculation formulas where $a_x$ and $a_y$ respectively represent the coordinates in the width direction and in the length direction of the pressure center position of the shoe sole:

$$a_x=(Fx\times a_z-My)/Fz$$

$$a_y=(Fy\times a_z+Mx)/Fz$$

wherein Fx, Fy, and Fz respectively represent three force components calculated from the force plate, $a_z$ represents the distance from the coordinate origin of the force plate to the working plane, and Mx and My represent composite moments acting on the force plate.

FIG. 9A shows the position of the pressure center in the length direction of the shoe sole in the early stage and the last stage of the running, and FIG. 9B shows the position thereof in the width direction of the shoe sole in the early stage and the last stage of the running. FIG. 9A shows the position of the pressure center in the length direction by the distance in the length direction from the heel-side end of the shoe sole serving as a starting point to the toe. FIG. 9B shows the position of the pressure in the width direction by the distance from the center line in the width direction serving as a base line, with the direction toward the outer foot side serving as the positive direction. Further, FIG. 10 shows a view schematically showing a change in pressure center position. In FIG. 10, P represents the pressure center in the early stage of running, and P' represents the pressure center in the last stage of running.

As is obvious from FIG. 9A, FIG. 9B, and FIG. 10, it is understood that the pressure center position shifts about 24 mm toward the toe side and about 5 mm toward the inner foot side on average, in accordance with changes in running form of the wearer due to fatigue in long-distance running. That is, it is understood that the pressure center position has shifted in the direction from the heel toward the midfoot. It is assumed that the characteristics of the shock absorber that the shock absorption changes corresponding to running distance can be exerted more effectively by the shock absorber of the present invention arranged at a position corresponding to the position from the calcaneal tuberosity to the vicinity immediately below the transverse tarsal joint based on the shift of the pressure center position mentioned above. Thereby, it is assumed that the shock absorber can exert an optimal shock absorption throughout from the early stage to the last stage of long-distance running.

REFERENCE SIGNS LIST

1, 1': Shoe sole
2: Shock absorber
3: Gel material
4: Foam material
P,P': Pressure center position

The invention claimed is:

1. A shock absorber formed by a resin composition and configured to be provided in a shoe, the shock absorber satisfying all formulas (1) to (4) below when changes in storage elastic modulus between 20° C. to 50° C. are linearly approximated by a least-squares method:

$$Y=aX+b \quad (1);$$

$$-0.1\leq a\leq -0.02 \quad (2);$$

$$1.0\leq b\leq 16.0 \quad (3); \text{ and}$$

$$R2\geq 0.75 \quad (4),$$

where X represents a temperature (unit: ° C.) of the shock absorber, Y represents a storage elastic modulus (unit: MPa) of the shock absorber, and R represents a correlation coefficient in the least-squares method.

2. The shock absorber according to claim 1, having:
a storage elastic modulus at 20° C. of 0.8 MPa or more and 4.0 MPa or less; and
a storage elastic modulus at 50° C. with respect to the storage elastic modulus at 20° C. of 1/11.0 to 1/1.6.

3. The shock absorber according to claim 1, having:
a storage elastic modulus at 20° C. of 1.0 MPa or more and 4.0 MPa or less; and
a storage elastic modulus at 50° C. with respect to the storage elastic modulus at 20° C. of 1/4.2 to 1/1.6.

4. The shock absorber according claim 1, being provided at a heel of the shoe.

5. The shock absorber according to claim 4, being provided at a position corresponding to medial process of calcaneal tuberosity of a foot of a wearer when the shoe is worn.

6. The shock absorber according to claim 4, being provided in a range of 5% position to 30% position in a length direction of the shoe sole and in a range of 20% position to 80% position in a width direction of the shoe sole, when a position in the length direction of the shoe sole of the shoe at a heel-side end in the length direction is referred to as 0% position, a position at a toe-side end is referred to as 100% position, a position in the width direction orthogonal to the length direction of the shoe sole at an end on an inner foot side of the shoe is referred to as 0% position, and a position at an end on an outer foot side of the shoe is referred to as 100% position.

7. A shoe sole comprising the shock absorber according to claim 1.

8. The shoe sole according to claim 7, wherein the shock absorber has:

a storage elastic modulus at 20° C. of 0.8 MPa or more and 4.0 MPa or less; and a storage elastic modulus at 50° C. with respect to the storage elastic modulus at 20° C. of 1/11.0 to 1/1.6.

9. The shoe sole according to claim 7, wherein the shock absorber has:

a storage elastic modulus at 20° C. of 1.0 MPa or more and 4.0 MPa or less; and a storage elastic modulus at 50° C. with respect to the storage elastic modulus at 20° C. of 1/4.2 to 1/1.6.

10. The shoe sole according to claim 7, wherein the shock absorber is provided at a heel of the shoe.

11. The shoe sole according to claim 10, wherein the shock absorber is provided at a position corresponding to medial process of calcaneal tuberosity of a foot of a wearer when the shoe is worn.

12. The shoe sole according to claim 10, wherein the shock absorber is provided in a range of 5% position to 30% position in a length direction of the shoe sole and in a range of 20% position to 80% position in a width direction of the shoe sole, when a position in the length direction of the shoe sole of the shoe at a heel-side end in the length direction is referred to as 0% position, a position at a toe-side end is referred to as 100% position, a position in the width direction orthogonal to the length direction of the shoe sole at an end on an inner foot side of the shoe is referred to as 0% position, and a position at an end on an outer foot side of the shoe is referred to as 100% position.

* * * * *